United States Patent [19]

Katz

[11] Patent Number: 4,953,864

[45] Date of Patent: Sep. 4, 1990

[54] METHOD AND APPARATUS FOR CHANCE CONTROLLED FORMATION OF A SYMBOL

[76] Inventor: Daniel Katz, 531 E. 20th St., New York, N.Y. 10010

[21] Appl. No.: 369,615

[22] Filed: Jun. 21, 1989

[51] Int. Cl.[5] ..... A63F 9/18

[52] U.S. Cl. ..... 273/161; 273/138 A

[58] Field of Search ..... 273/1 M, 138 A, 142 JB, 273/143 C, 161, 239

[56] References Cited

U.S. PATENT DOCUMENTS

| | | | |
|---|---|---|---|
| 3,598,414 | 8/1971 | Dhiegh | 273/161 |
| 3,633,916 | 1/1972 | Thomas | 273/142 JB |
| 4,462,596 | 7/1984 | Yamamoto | 273/239 |

*Primary Examiner*—Edward M. Coven
*Assistant Examiner*—Raleigh W. Chiu
*Attorney, Agent, or Firm*—William E. Pelton

[57] ABSTRACT

A method and apparatus for successively determining each line of a trigram or hexagram used in consulting the I-Ching. Indistinguishable magnets, preferably bar magnets, are selected at random and brought into proximity, allowing the magnetic poles of the magnets, so juxtaposed, to exhibit attraction or repulsion. States of the lines of the trigram or hexagram as broken or unbroken are assigned to each observed magnetic interaction. The lines so determined are visually displayed as a group to form the I-Ching hexagram.

46 Claims, 6 Drawing Sheets

FIG. 4a
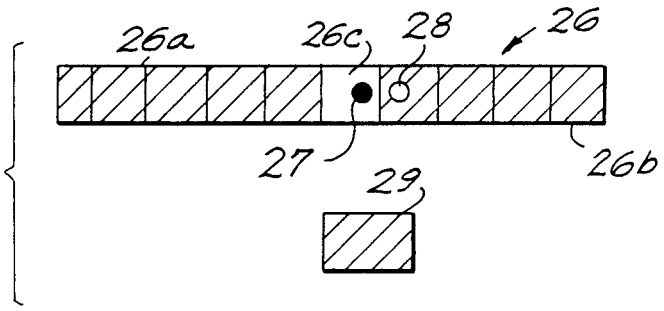
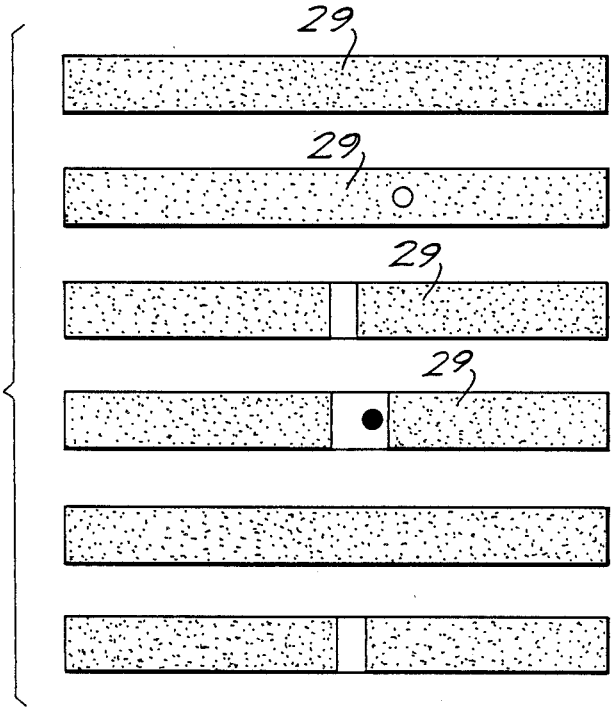
FIG. 4b

METHOD AND APPARATUS FOR CHANCE CONTROLLED FORMATION OF A SYMBOL

FIELD OF THE INVENTION

The present invention relates in general to methods and apparatus for obtaining chance-controlled images or patterns, and in particular to a method and associated apparatus for generating personalized chance-controlled images or patterns which may be correlated to a communications code or to the structural aspects of a language, for example words, phonemes or the alphabet, or which enable interrogation of a forecasting medium such as the I-Ching, an ancient and venerable Chinese guide to insight and decision making.

BACKGROUND OF THE INVENTION

Chance-controlled question and answer devices have been known heretofore. In many such prior arrangements, a chance-controlled indicator is utilized to select a symbol which may be used to access coded source materials. For example, in U.S. Pat. No. 1,155,851 to J. Welch, a rotatable pointer is adapted for chance registration with one of a plurality of radial sectors formed on a gameboard. Each sector has a unique symbol associated with it which is used together with a deck of cards and an associated book of answers as a guide to ascertain the answer to a question posed. U.S. Pat. No. 880,640 to C. H. Emerson discloses a chance-controlled device which is used with a book having a series of coded questions and answers. The chance-controlled mechanism consists of a receptacle provided with a ball-mixing chamber and a plurality of ball pockets in which balls from the mixing chamber are received in a file or row. The balls are colored so as to portray a pattern obtained by chance which corresponds to one of the coded answers. U.S. Pat. No. 4,462,596 to Yamamoto discloses a stacking game device in which a plurality of magnetized game pieces are inserted one at a time on top of one another into each of a plurality of cylindrical bores formed in a piece holder block. The length of each stacked row of game pieces formed thereby will vary depending upon whether individual pieces within each of the bores are subject to magnetic attraction or repulsion acting between the opposed ends of the pieces. For example, a stack of such magnets in which two or more are subject to mutually repulsive forces will extend outwardly from the holes in the piece holder. Such variations in the lengths of the rows of magnets may be visually or tactily perceptible and thereby used to play a game.

While such prior type of chance-controlled devices may be used together with a fortune book for the purpose of foretelling the future on the basis of a chance selection of a coded symbol, none suggests a method or technique based upon magnetic phenomena to create or form a symbol, particularly the lines of trigrams and hexagrams which are needed in order to consult the I-Ching.

Traditionally, an I-Ching hexagram is constructed line by line, beginning with the bottom line. For each line of the hexagram, the consultant of the I-Ching must use a chance method to determine whether the line is to be solid or broken, the most fundamental element of the process. Each hexagram is constructed of six such lines, with each line having two possible states, i.e., broken or unbroken. Each such hexagram, and there are sixty-four distinct hexagrams, and its constituent lines is the subject of a coded oracular pronouncement and commentary which may be located within the written text of the I-Ching.

Several methods have been utilized heretofore for creating a hexagram to be used in consulting the I-Ching. One of the most ancient of such techniques is referred to as the Yarrow Oracle and involves the use of fifty stalks, preferably from the yarrow plant. Bamboo skewers were also used, as have been drinking straws in more recent times. The stalks are divided into random groups or piles in accordance with ancient and understood steps. Tradition has dictated various manipulations and countings of the groups of stalks in order to determine the several lines of each hexagram.

Because the process for the Yarrow Oracle is intricate and time consuming, another method of determining the character of a line of the hexagram was devised. This alternative method involves the tossing of three coins, the sides of which are assigned arbitrary numerical values. This technique for defining the lines of an I-Ching hexagram is known as the Coin Oracle. The Coin Oracle is somewhat simpler to perform than the Yarrow Oracle because there are only four possible results from the toss of the three coins: three heads, two heads, two tails and three tails. Once again, tradition has assigned the creation of a broken line to certain of the results from a toss of the coins and the creation of a solid line to other such results. Each throw of the coins determines a single line of the hexagram.

Both the Yarrow and Coin Oracles may be criticized as being indirect, i.e., relying on an arbitrary equivalence of the numbers resulting from the various manipulative methods to the character of a line of the hexagram. In addition, both require the relatively time consuming intermediate steps of writing down the result of each manipulation so that the separate lines of the hexagram will be remembered. Moreover, neither of these methods for producing a hexagram can produce a single unique result representative of a solid line and another single unique result representative of a broken line. Both prior methods produce multiple results in the form of numbers which must be further attributed to one type of line or the other. This inability of the prior methods to produce a single definite result for each of the two types of lines of the hexagram diminishes the claim that such methods are perfectly representative of two fundamental and distinct elemental forces at work in the universe.

A principal object of the present invention is to provide a method and apparatus for generating personalized chance-controlled images or patterns which may be correlated to words, letters, sounds or other information yielding communications codes and the like.

Another object of the present invention is to provide a method and apparatus by which the lines of the I-Ching hexagram may be formed directly, without the necessity for complex or arbitrary intermediate steps, calculations or writings.

Still another object of the present invention is to provide a method and apparatus by which the lines of the I-Ching hexagram may be formed through utilization of the elemental force of magnetism and the unpredictability of the interrelationship which develops between a plurality of randomly juxtaposed magnets.

Yet another object of the present invention is to create the lines of an I-Ching hexagram as a reflection of the basic universal force of magnetism, the resulting lines of the hexagram being thereby more demonstrative than previous methods of universal forces and the interrelationship of opposites, upon which the theory and philosophy of the I-Ching is based.

A further object of the present invention is to provide a Magnetic Oracle method for chance generation of the lines of the I-Ching hexagram which is more direct and more convenient than the prior known methods.

A still further object of the present invention is to provide a Magnetic Oracle method for chance generation of the lines of the I-Ching hexagram in which the instruments of chance, in and of themselves, form a direct visual representation of the lines of the hexagram.

A yet further object of the present invention is to provide a method and apparatus by which the lines of the I-Ching hexagram may be formed by the chance-controlled selection of pre-established fragments or sections of the traditional symbol of the two opposing forces upon whose interaction a major theory explaining the operation of the I-Ching is based.

SUMMARY OF THE INVENTION

In accordance with a preferred embodiment of the present invention, a plurality of relatively indistinguishable objects having otherwise unrevealed magnetic poles may be randomly brought into such proximity as to allow a magnetic pole of one of the objects to demonstrate attraction or repulsion relative to the magnetic pole of a proximate adjacent object. A visual representation, for example, of one line or a portion of a line of an I-Ching hexagram may thereby be obtained, either by observing the magnets themselves, or by observing predetermined indicia thereon or by assigning a portion of the desired symbol to each type of magnetic interaction. In the preferred embodiment, the objects consist of small bar magnets, however, it will be understood that the invention is not to be limited to the use of bar type magnets. In general, the present invention encompasses any method or apparatus by which the chance occurrence of a particular magnetic interaction results in the selection of a visually apparent representation of either a broken or solid line. The step of selecting an interacting pair of magnetic poles at random and obtaining a visually apparent response indicative of a line or a portion of a line, may be repeated as often as is necessary to enable one to determine a line and to obtain a sufficient number of such lines to complete an I-Ching hexagram.

Where bar magnets are utilized, the line of the hexagram may be completed directly, such as, for example, where two bar magnets attract each other and thereby form a representation of a solid line, or repel each other, thereby forming a representation of a broken line. However, it should be understood that the use of such random magnetic interaction may also constitute a method of choosing between alternatives whereby each such magnetic result is assigned a contemplated alternative which, in turn, is deemed to be representative of a desired visual occurrence such as a broken or solid line.

It will be understood, for example, that the magnetic method for obtaining the lines of an I-Ching hexagram may be employed in a wide variety of ways. By way of illustration, suitable bar magnets may simply be arranged by hand on a flat surface. For this purpose, no more than two such bar magnets would be required since they may be shuffled and reused six times to obtain the six lines of the hexagram. Alternatively, the magnets may be placed one-by-one in a suitable receptacle for holding the magnets and visually displaying the alignment of the randomly selected magnets. Electromechanical means may also be employed for selecting and manipulating the magnets. Where magnets other than bar magnets are used, mechanical means responsive to the occurrence of a particular magnetic interaction may be utilized to create a visual display representing a line or a portion of a line.

Other techniques for randomly obtaining a magnetic interaction and for generating a resultant visual display indicative of the lines of a hexagram may be utilized by those skilled in the art without departing from the scope of the present invention. For example, when properly subdivided, predetermined segments or portions of the traditional "Yin-yang" symbol may be correlated to broken or solid lines of the I-Ching hexagram. Chance-controlled selection of successive ones of a group of such pre-established portions of the traditional "Yin-yang" symbol may be accomplished by methods ranging from magnetic interactions to blind selection or drawing of physically separated portions of the symbol, each such portion being assigned to represent one state for the line of a hexagram. A variety of other physical methods of indicating or pointing out the sections of the symbol may be utilized without departing from the scope of the invention.

BRIEF DESCRIPTION OF THE DRAWINGS

For a further understanding of the present invention, reference may be had to the accompanying drawings, in which:

FIG. 1(*a*) is a sectional view of a magnet having a pentagonal cross section;

FIG. 1(*b*) is a sectional view of a magnet having a haxagonal cross section;

FIG. 4*a* is a schematic illustration of a single and more advanced display line which may be used together with other similar display lines in connection with the receptable embodiment of FIG. 3;

FIG. 4*b* is a schematic illustration of the different display possibilities which may be created with an advanced display line of the type depicted in FIG. 4;

BRIEF DESCRIPTION OF THE PREFERRED EMBODIMENTS

Figure 1:
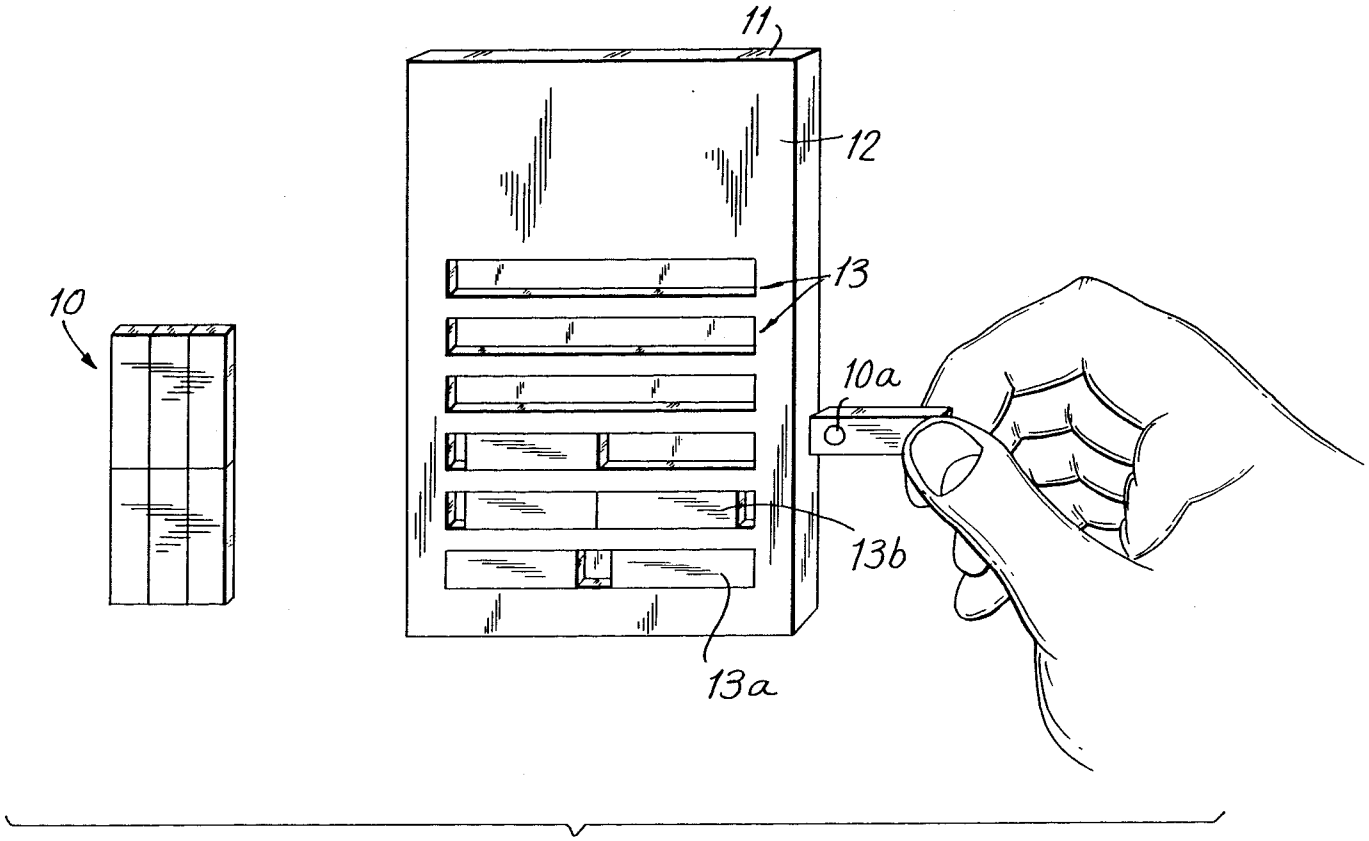
FIG. 1 is a perspective view of one embodiment of a receptacle adapted to display bar magnets to form the lines of an I-Ching hexagram in accordance with the method of the present invention.

With reference now to the drawings, and in particular to FIG. 1, there is shown a first embodiment of an apparatus in accordance with the present invention and adapted for use in connection with the present Magnetic Oracle, which is a chance-controlled method of producing an I-Ching hexagram in accordance with random magnetic interactions. In this embodiment, a plurality of small permanent bar magnets, generally indicated by reference numeral 10, may be used to generate the lines of the hexagram. While six such magnets are shown, it will be understood that where two magnets are required for each of six lines of a hexagram, a total of twelve (12) such bar magnets is preferred for this embodiment.

A suitable magnet receptacle or holder frame 11, preferably in the form of solid block, may be provided for the purpose of retaining the bar magnets in appropriate alignment so that each pair of bar magnets represents one of the lines of a hexagram. The holder 11 is preferably made of non-magnetic material having a flat outer surface area or front face 12 which is provided with a plurality of spaced apart and substantially parallel horizontal grooves 13. For purposes of this invention, each of the grooves 13 is adapted to contain a pair of bar magnets 10 inserted end-to-end therein by hand as shown. Thus, each pair of bar magnets so arranged in one of the grooves 13 is representative of one line of an I-Ching hexagram, and therefore the total number of such grooves formed in the holder or block 11 is preferably six. It is evident that should a consultant wish to construct trigrams, only three such grooves need be provided in the block 11.

To consult the I-Ching in accordance with the present embodiment, a consultant randomly selects one bar magnet from the supply of magnets which, in the present embodiment, may be a group of from two to twelve indistinguishable magnets. This first magnet is then placed in the lower-most groove **13*a* of the six horizontal grooves 13. A second bar magnet is then selected, also at random, and is placed in the same groove 13*a* as the first magnet, so that the two magnets are oriented end-to-end in the groove. As illustrated in FIG. 1, the two magnets will either be oriented with adjacent identical magnet poles, in which case the repulsive magnetic force will cause the magnets to be separated as indicated at 13*a*, or the magnets will be oriented such that opposite magnetic poles will attract the magnets to abut together as indicated at 13*b*. This process is repeated for each of the grooves until all twelve magnets have been placed in the grooves and a total of six lines has been formed. It is evident that depending upon whether two adjacent magnets attract or repel each other, each of the six individual lines formed by the bar magnets and displayed by the holder or block 11 will either represent a broken line 13*a* or a solid line 13*b***. Of course, one may assign the state of a solid line to magnetic repulsion of said poles and assign the state of a broken line to magnetic attraction of the poles of the magnet, as may be desirable in order to form the individual lines of the hexagram. The resulting display of six lines, any one of which may be a broken or solid line, represents a hexagram which may be used to consult a particular text of the I-Ching corresponding to such hexagram. Thus, the consultant may thereby construct the actual hexagram itself, simply, directly, and perfectly subject to chance in accordance with magnetic interactions, one of nature's basic forces.

It should be understood that the grooves 13 may be formed in the outer surface of the holder or block 11 so that the magnets are emplaced by hand from the front, as depicted in FIG. 1, or may be constructed in any other way which permits the magnets to be aligned end-to-end in a displayable position such that the six individual lines of adjacent bar magnets may be viewed together to represent a hexagram. For example, the magnets may be placed in position from the rear of the holder or from the side, as may be desired.

Figure 1A:
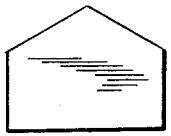
Figure 1B:
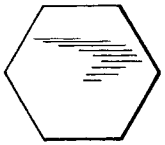

Referring to FIGS. **1*a* and 1*b*, the magnets 10 may as desired be pentagonal in cross-section, as shown in FIG. 1*a* or hexagonal in cross-section as shown in FIG. 1*b***.

Figure 2:
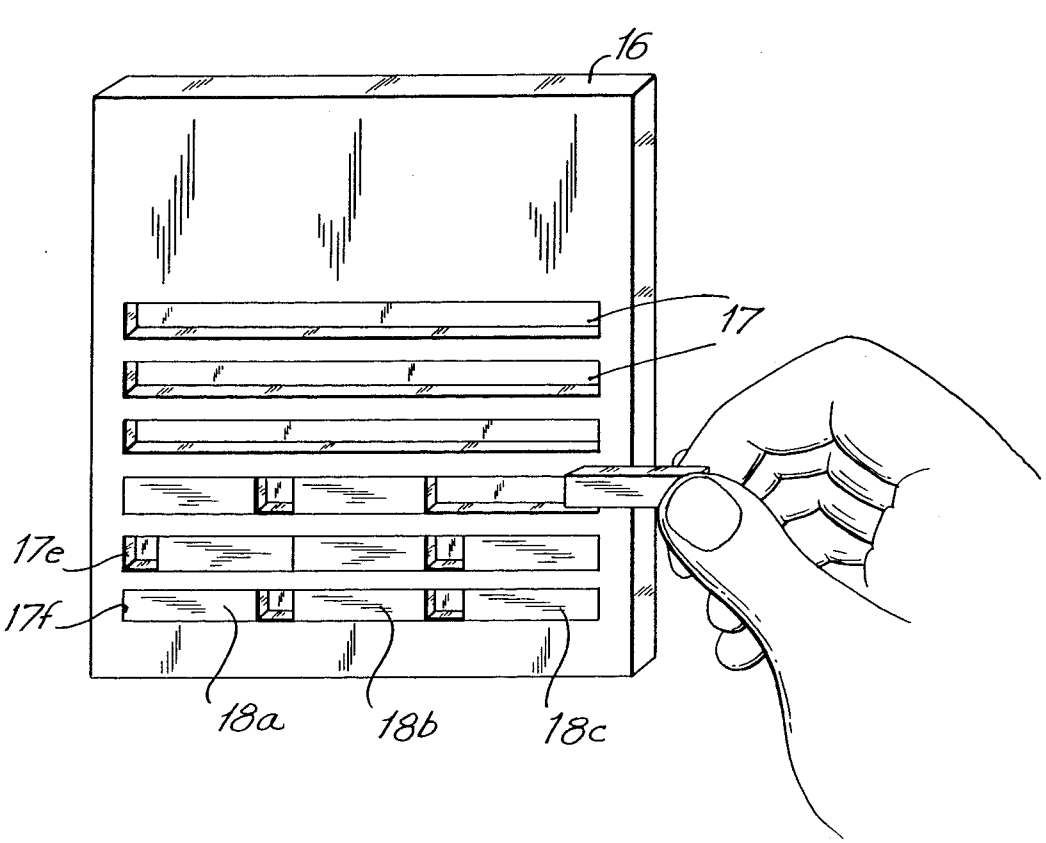
FIG. 2 is a perspective view of another embodiment of a receptacle adapted to display bar magnets to form the lines of an I-Ching hexagram in accordance with the method of the present invention.

Referring now to FIG. 2, there is shown a more advanced version of the present Magnetic Oracle method and apparatus for consulting the I-Ching. In this embodiment, the holder or block 16 may be quite similar to the holder or block 11, as shown in FIG. 1, but is preferably wider so that each of the magnet retaining grooves 17 is somewhat longer. The longer grooves permit the insertion into each of the grooves 17 of a total of three permanent bar magnets aligned end-to-end. Thus, in this embodiment each of the lines of the hexagram will be represented by three bar magnets.

The foregoing modified arrangement permits the consultant to make use of a more advanced concept associated with consultation of the I-Ching, known as "moving" lines of the hexagram. Such "moving" lines have additional significance and subtlety in consulting the I-Ching, enabling the consultant to obtain more comprehensive information from the I-Ching text. For example, where only two magnets are used for each line, then only two possibilities exist and the result will always be either a "strong" solid line or a "strong" broken line. If, on the other hand, the consultant prefers the added subtlety of "moving" lines, the use of a third magnet for each line creates two additional possibilities for each of the lines of the hexagram. With reference to FIG. 2, the bottom line of a hexagram to be displayed by the holder or block 16 has been completed with the insertion of three magnets **18*a*, 18*b*, and 18*c* into the groove 17*f*. Magnets 18*a* and 18*b* are seen to be repelling, thereby creating a broken line. Where the consultant wishes to use the concept of "moving" lines, the third magnet 18*c* is added to the line. In the example of FIG. 2, the third magnet 18*c* is seen to repel the adjacent magnet 18*b* in the line. This arrangement may be deemed to create a "strong" broken line which would not be a "moving" line. Conversely, if the third magnet 18*c* had been attracted to the second magnet 18*b*, a "weak" or "moving" broken may be deemed to have been established. By the same rationale, the magnets retained in the groove 17*e*** would represent a "weak" or "moving" solid line because the first two magnets are attracted together while the second and third magments repel. In this embodiment, the concept of "moving" lines may be employed where the total number of available magnets is from three to eighteen.

It should be understood that the concept of "moving" lines may also be employed where no more than four bar magnets are available to the consultant. For example, one face on one of the,. four bar magnets may be marked with a color or a symbol **10*a* (FIG. 1**), such as a white dot. The magnets are then selected at random and interacted to form a line, as described above. If the marked face shows in the resulting line, the line is designated as "moving". This allows the feature of moving lines to be offered with as few as four magnets, while maintaining something close to the traditional probabilities as established by the Yarrow or Coin Oracles, although with respect to the concept of "moving" lines, the Coin and Yarrow Oracles are not equivalent. Where only two bar magnets are available, appropriate probabilities for "moving" lines may still be obtained where each of the magnets has a square cross section, i.e., each magnet has four equal rectangular faces.

Figure 3:
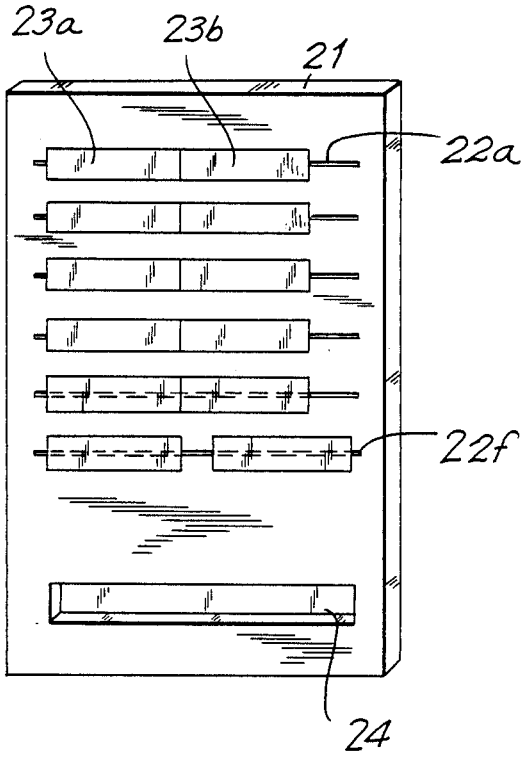
FIG. 3 is a perspective view of still another embodiment of a receptacle for use in accordance with the magnetic method of the present invention and adapted to display the lines of a hexagram without using bar magnets as part of the display.

Referring now to FIG. 3, there is illustrated yet another embodiment of a hexagram display block adapted to be utilized, for example, where a consultant of the I-Ching does not wish to use permanent bar magnets for the visual display of the completed hexagram. In accordance with the present embodiment, such a display may consist of a support block 21 which is provided on one outer surface or face thereof with six horizontal and substantially parallel slots 22*a*–22*f*. Each of the slots 22 (*a*–*f*) retains one or more sliding bar indicators such as indicators 23*a* and 23*b*, which are slidably retained end-to-end within the slot and may be moved back and forth relative to the support block and to each other. The length of the slot and the longitudinal dimension of each sliding bar indicator are such that there is sufficient length in the slot for two such indicators retained therein to be spaced apart, as shown in connection with lower-most slot the bottom line 22*f*, thereby to indicate a broken line of the hexagram.

The support block 21 is preferably provided with a horizontal groove 24 on the front face thereof and which is preferably situated below and substantially parallel to the slots 22(*a*–*f*). The groove 24 may be adapted to receive and retain two or three bar magnets aligned end-to-end therein. In this way the magnetic hexagram method of the present invention may be practiced by repetitively placing the bar magnets end-to-end in otherwise random fashion within the groove 24. The magnetic interaction between the magnets will determine whether each line so made will represent a solid, broken or "moving" hexagram line,.as described above. For each such line successively generated, the result may be recorded by moving the appropriate pair of sliding indicators to reflect the positions achieved by the magnets. It will be evident that after randomly placing the magnets in the groove 24 six times, and recording the results as described, the sliding indicators will display a full hexagram. In this embodiment the support block 21 may be made of non-magnetic or magnetic material. If the block is made of magnetic materials, the individual magnets may be magnetically attached to it for portability. Otherwise, a strip of metal may be suitably affixed to the block to which the magnets may be magnetically attached. It should be understood that other forms of sliding display indicators may be utilized with a suitable supporting frame or device without departing from the scope of the invention.

FIGS. 4*a* and 4*b* illustrate schematically a more advanced embodiment of a sliding indicator display line which may be used in connection with the display embodiment of FIG. 3. In particular, the display line depicted in FIG. 4*a* takes into account the possibility of using "moving" lines to obtain additional information from the I-Ching for each hexagram.

In this embodiment, the front face of the support block 21 is provided with six substantially parallel and spaced apart multi-colored stripes, such as the single stripe 26 shown in FIG. 4*a*. Each of the stripes 26 contains aligned colored segments 26*a* and 26*b* of predetermined color, for example black, which extend inwardly and toward each other from each lateral edge of the stripe. The segments 26*a* and 26*b* terminate near the middle of the stripe, leaving a short segment 26*c* therebetween, substantially at the middle of the strip. The middle segment 26*c* is preferably of a contrasting color, for example, white. As shown, the white middle segment 26*c* is provided with a black dot 27, and the adjacent inner end of one of the black segments of the stripe, for example the segment 26*b*, is provided with a contrasting white dot 28. Any suitable indicia may be used in place of the black dot 27 and the white dot 28, without departing from the scope of the invention.

In this embodiment, there is only a single sliding piece 29. The sliding piece 29 is large enough to overlie and completely cover the white middle segment 26*c* of the stripe and, at the same time to cover the white dot 28. When so positioned, the sliding piece transforms the appearance of the stripe into a solid black line. The sliding piece 29 may be slidably affixed to the surface of the support block in any suitable way. For example, it may reside in a small slot centered within the outlines of the strip 26 and thereby be adapted to be moved laterally back and forth alternately to expose a part or all of the white middle segment 26*c*, or to cover the white segment 26*c* and expose only the white dot 28, as desired. Any suitable means for slidably mounting the piece 29 on the support block may be utilized without departing from the scope of the invention.

The different possibilities for such lines of a hexagram are illustrated schematically in FIG. 4*b*, where colored stripes representing the six parallel lines of the hexagram are depicted. In the uppermost line, the sliding piece 29 has been moved to cover both the middle white segment 26*c* and the white dot 28, thereby creating a "strong" solid line. In the second line, the sliding piece 29 has been moved to expose only the white dot 28, thereby creating a "moving" solid line. In the third line, the sliding piece has been moved to cover both the white and black dots, but to expose a portion of the middle white segment, thereby creating a strong broken line. In the fourth line, the sliding piece has been moved to expose the entire middle segment 26*c* together with the black dot, but to cover the white dot thereby creating a "moving" broken line. In this way, an advanced hexagram of solid, broken and, where appropriate, "moving" lines may be created.

Figure 5:
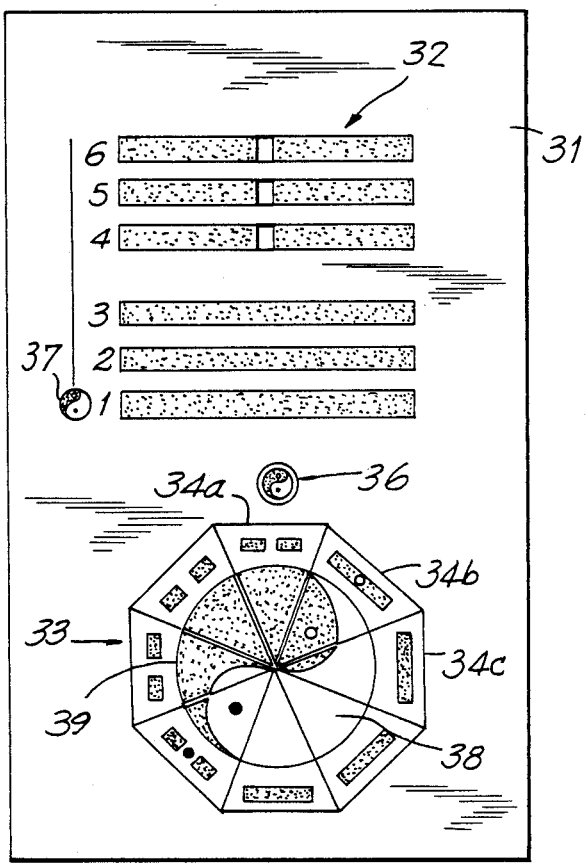
FIG. 5 is a plan view of a display of the type depicted in FIG. 3, but having an octasection rotator for use in the method of the present invention.
Figure 5A:
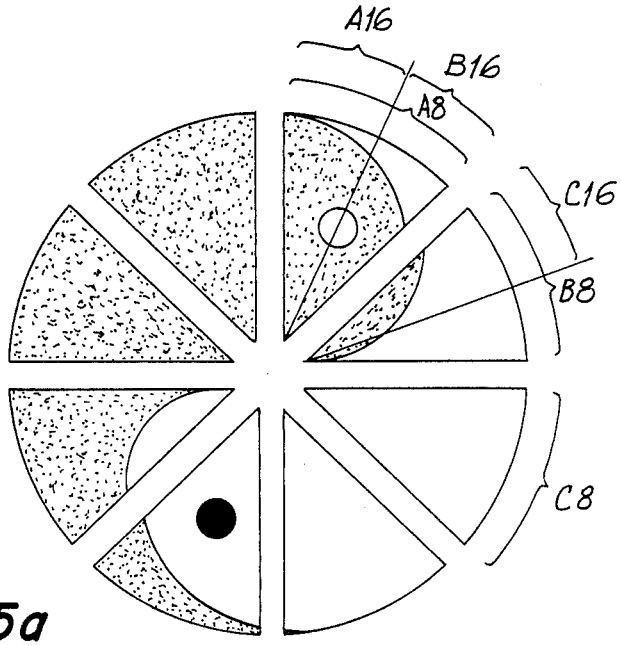
FIG. 5*a* is a schematic view of a traditional Yinyang symbol divided into a plurality of sectors in accordance with the present invention.

Referring now to FIG. 5, there is shown another embodiment of the present invention in which a suitable support block 31, preferably of any of the types described above, is provided with a sliding piece display 32 of the type generally described in connection with FIGS. 3 and 4. In this embodiment, the determination of each of the different lines of the hexagram to be displayed by the display 32 is magnetically chance-controlled by a single fixed magnet 36 and a rotatable roulette type wheel 33, preferably in the form of an octagon. Each facet 34*a*–34*h* of the octagonal wheel 33 is provided with indicia representing one possibility for a line of the hexagram. For example, indicia associated with the facet 34*a* depicts a strong broken line, indicia on the facet 34*b* depicts a "moving" solid line, while indicia on the facet 34*c* shows a strong solid line, and so forth.

The fixed magnet 36 is preferably a small permanent magnet located on the surface of the display block 31 in a position adjacent the periphery of the octagonal wheel 33. The magnet 36 is positioned so that one of its magnetic poles faces the octagonal wheel. Each facet of the wheel is provided with a magnetic pole selected so as to attract the corresponding magnetic pole of the magnet 36. The magnet 36 thereby acts as a stabilizing magnet so that when the octagonal wheel is spun, it will come to rest and be held at a position determined by a random correspondence between the fixed magnet and one of the facets 34. Thus, each rest position of the wheel 33 will define a chance indication of one of the various possibilities for a line of an I-Ching Hexagram as depicted at its perimeter. In this way each successive spin of the wheel 33 results in the chance magnetic selection of one line of a hexagram. It is evident that a complete hexagram may be determined by six spins of the wheel.

Each line of the hexagram, so determined, is recorded by adjusting the individual lines of the sliding display 32 as described above in connection with FIGS. 3 or 4. A sliding pointer 37 may be provided on the support block in a suitable position to enable the consultant to keep track of which line of the hexagram is being determined at any particular time.

In the present embodiment, the rotatable roulette type wheel 33 is provided with the ancient and distinctive symbolic coloration known as the "Yin-yang symbol". In general, the "Yin-yang" symbol is an emblem which evokes the harmonious interplay of all pairs of opposites in the universe depicted as the light and dark interpenetrating halves, 38 and 39 respectively, of a circle. When the "Yin-yang" symbol is used on the wheel 33, for example, it is possible to eliminate the indicia depicting a broken or solid line at the periphery of each facet of the wheel, as shown in FIG. 5. Remarkably, it turns out that when the "Yin-yang" symbol is divided into eight equal segments, as depicted in FIG. 5 for the octagon shape wheel, there is a unique correspondence between each segment of the symbol and a broken, solid or "moving" line for an I-Ching hexagram. For example, each generally solid color segment could be assigned to correspond to either a strong broken or solid line while each segment having one of the dots could be assigned to correspond to a "moving" line. In this way, the same results can be achieved as with the embodiment depicted for the wheel 33 in FIG. 5.

Even more interesting results may be achieved if the circle bearing the "Yin-yang" symbol were to be divided into sixteen equal sections, such as is depicted in FIG. 5(*a*). In this embodiment, there will be three mixed-color segments of each type which could be considered to represent "moving" lines. For example, each of the segments A16, B16 and C16 is of the mixed-color type and could be assigned to represent a "moving" line. This arrangement accomplishes a remarkable balancing of the 3 in 16 probability which the Yarrow Oracle method has for generating moving solid lines. Unlike the Yarrow Oracle however, the present invention gives that same probability to broken lines as well. In this arrangement, a small permanent magnet could be provided at the periphery of each of the segments of the wheel. Each such magnet will interact with the fixed magnet 36 to define each rest position of the wheel and thereby select one segment of the "Yin-yang" symbol to define one line of an I-Ching hexagram, as described above. It should be understood that even where a magnetic interaction is not utilized, the same results may be accomplished by physically dividing a "Yin-yang" symbol into a plurality of "pie" shaped segments, either eight or sixteen as desired, and randomly selecting individual ones of the segments to define each of the lines of the hexagram. It should also be understood that the extent of the interpenetration of the light and dark interpenetrating halves of the "Yin-yang" symbol and the number of sections into which the "Yin-yang" symbol can be divided, may be varied without departing from the scope of the invention.

This utilization of a segmented "Yin-yang" symbol adds subtlety to a consultation of the I-Ching because it allows a user to distinguish between different types of moving lines. For example, certain of the mixed-color segments could be assigned to represent movement in which a new line is clearly being brought in, while other segments of the symbol could be assigned to represent the situation where movement towards a new line is just beginning. This will alleviate the problems which have arisen heretofore in I-Ching consultations where a multiplicity of moving lines show up and it is difficult to determine how much weight to assign to them in deciphering the hexagrams.

Figure 6:
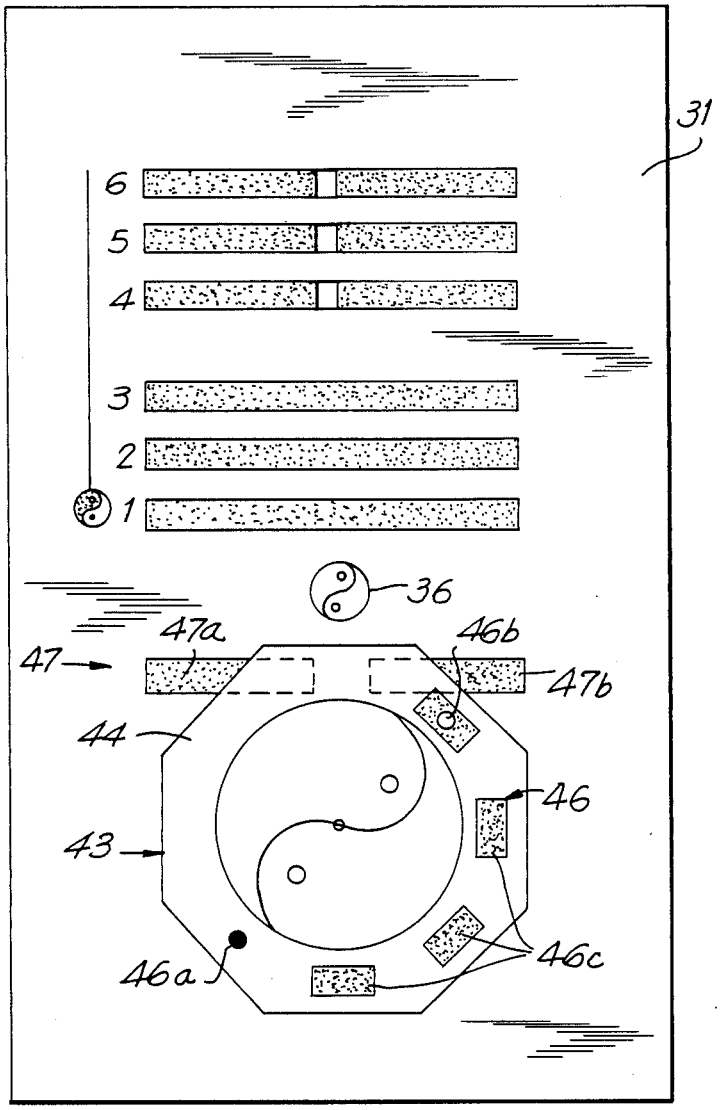
FIG. 6 is a plan view of an alternate embodiment of the display of FIG. 5 for use in the method of the present invention.

Referring now to FIG. 6, there is shown an alternate embodiment of a display of the type shown in FIG. 5. In this embodiment, the octagonal wheel has a transparent peripheral portion 44 with spaced-apart indicia 46 printed thereon in predetermined positions. The indicia 46 include a black dot 46*a*, a white dot formed on a black background 46*b* and three black segments 46*c*. The rest of the periphery of the wheel may remain clear.

The surface of the support block 31 is provided with a printed broken line 47 consisting of two separated solid color segments 47*a* and 47*b*. The line 47 is located so that the broken portion of it is within the periphery of the wheel 33 and is visible through the clear peripheral portion 44. When the wheel is spun and comes to rest under the influence of the fixed magnet 36, a completed line of the hexagram results, the nature of which depends upon which, if any, of the indicia 46 printed on the upper surface of the wheel periphery 44 overlies the fixed printed line 47. For example, as shown in FIG. 6, the wheel has come to rest in such a position that none of the movable indicum on the wheel 43 has been superimposed over the broken printed line 47. Thus, the magnetic interaction between the magnet 36 and the spinning wheel 44 has resulted in the chance formation of a strong broken line for the hexagram. In contrast, the chance superpositioning of the black dot 46*a* over the broken line 47 would have resulted in the formation of a "moving" broken line, and so on. Accordingly, by successive spins of the wheel 43, each line of the hexagram may be formed, in accordance with the present invention, solely as a result of a chance magnetic interaction.

While the present invention has been described herein in connection with certain preferred embodiments, it will be understood that various modifications may be made by persons skilled in the art without departing from the scope of the invention, which is to be measured solely by the following claims:

What is claimed is:

1. A method for determining by chance the state for each of a plurality of lines having more than one possible state, comprising the steps of:

(a) inducing a magnetic interaction between two randomly selected magnetic poles;

(b) assigning to said magnetic interaction a predetermined one of the possible states for a line;

(c) obtaining a visual representation of a line in accordance with said assigned state; and (d) repeating steps (a)–(c) until the state of each line is visually apparent.

2. The method of claim 1, in which said step of inducing a magnetic interaction comprises juxtaposing a first pair of magnetic poles selected at random from a plurality of magnetic poles.

3. The method of claim 2, in which said step of juxtaposing said first pair of magnetic poles comprises positioning said first pair of magnetic poles next to one another in such proximity as will allow said proximate poles to show magnetic attraction or repulsion.

4. The method of claim 3, comprising assigning the state of a broken line to magnetic repulsion of said poles and assigning the state of a solid line to magnetic attraction of said poles.

5. The method of claim 4, in which said magnetic poles comprise bar magnets and said step of obtaining a visual representation of a line comprises aligning said first selected pair of said bar magnets end to end, said bar magnets being movable relative to each other to display magnetic attraction or repulsion of the poles thereof.

6. The method of claim 5, comprising aligning successive selected pairs of said bar magnets end to end to determine the state for each respective line.

7. The method of claim 6, comprising the step of positioning each of said selected pairs of said bar magnets one above the other to form a predetermined group of lines.

8. The method of claim 7, comprising forming six parallel lines, each of said lines consisting of one of said selected pairs of bar magnets.

9. The method of claim 5, in which each of said bar magnets has at least four substantially equal faces.

10. The method of claim 9, in which each of said bar magnets has a substantially square cross section.

11. The method of claim 9, in which each of said bar magnets has a substantially pentagonal cross section.

12. The method of claim 9, in which each of said bar magnets has a substantially hexagonal cross section.

13. The method of claim 9, in which at least one face of one out of at least four of said bar magnets is provided with indicia so as to indicate a moving line when said indicia is visible in the line.

14. The method of claim 9, in which the number of said bar magnets is two, and one face of one of said bar magnets is provided with indicia so as to indicate a moving line when said indicia is visible in the line.

15. The method of claim 3, comprising assigning the state of a solid line to magnetic repulsion of said poles and assigning the state of a broken line to magnetic attraction of said poles.

16. The method of claim 3, in which one of said magnetic poles is fixed and the others of said magnetic poles are movable relative to said fixed pole.

17. The method of claim 16, in which said others of said magnetic poles are mounted on a rotatable member.

18. The method of claim 17, in which said rotatable member is provided with indicia in the form of a Yin-yang symbol on one face thereof, said symbol comprising a plurality of substantially equal sectors, one each of said others of said magnetic poles being provided at the periphery of each of said sectors.

19. The method of claim 18, in which said indicia is divided into eight sectors.

20. The method of claim 19, in which said indicia is divided into sixteen sectors.

21. The method of claim 1, comprising repeating steps (a)–(c) six times thereby to define a symbol consisting of six parallel lines.

22. The method of claim 1, comprising repeating steps (a)–(c) three times to form a symbol consisting of three parallel lines.

23. A method for determining by chance the state for each of a plurality of lines having more than one possible state, comprising the steps of:

(a) representing the Yin-yang symbol as a plurality of substantially equal shaped sectors;

(b) randomly selecting one of said sectors;

(c) assigning a predetermined one of the possible states for a line to said selected sector; and (d) repeating steps (b)–(c) until the state of each line is obtained.

24. The method of claim 23, in which the Yin-Yang symbol consists of a composite of said sectors in the form of a circular disc.

25. The method of claim 24, in which said number of said sectors is eight.

26. The method of claim 24, in which the number of said sectors is sixteen.

27. The method of claim 24, in which each of said sectors is provided with a magnetic pole.

28. The method of claim 27, in which said circular disc is rotatably mounted.

29. The method of claim 28, in which said repeating step comprises successively causing said circular disc to rotate until it returns to a rest position, each of said rest positions determining one of said selected sectors.

30. The method of claim 29, in which each of said rest positions is determined by a magnetic interaction engaged in by one of said magnetic poles.

31. The method of claim 23, wherein the step of assigning comprises attributing each different portion of the Yin-yang symbol to represent one of said states for a line.

32. A method for determining by chance the state for each of a plurality of lines having more than one possible state, comprising the steps of:

(a) inducing a magnetic interaction between at least a pair of separate randomly selected magnetic poles;

(b) assigning to each said magnetic interaction a predetermined one of the possible states for a line; and (c) obtaining a visual representation of a line in accordance with each said assigned state.

33. Apparatus for determining by chance the state for each of a plurality of lines having more than one possible state, comprising:

means for inducing a magnetic interaction between a pair of separate randomly selected magnetic poles;

means for visibly representing said magnetic interaction as one of said possible states for a line; and means for recording said represented state for a line.

34. The apparatus of claim 33, comprising means for visibly recording a plurality of successive ones of said represented states for a line.

35. The apparatus of claim 33, in which each of said magnetic poles is formed at one end of a bar magnet.

36. The apparatus of claim 35, in which said representing means comprises means for aligning a pair of said bar magnets end to end, said bar magnets being movable relative to each other.

37. The apparatus of claim 35, in which said representing means comprises means for aligning multiple pairs of said bar magnets end to end.

38. Apparatus for determining by chance the state for each of a plurality of lines having more than one possible state, comprising:

means for representing a random magnetic interaction between a pair of separate magnetic poles as one of said possible states for a line; and means for visibly recording said represented state for a line.

39. The apparatus of claim 38, in which said representing means comprises a rotatable member and means for determining a plurality of rest positions for said rotatable member, each of said rest positions defining one of said possible states for a line.

40. The apparatus of claim 39, in which said rotatable member is provided with a plurality of movable indicia, each one of said movable indicia defining one of said rest positions and being representative of one of said possible states for a line.

41. The apparatus of claim 40, in which said movable indicia are spaced in general conformity with the circumference of said rotatable member substantially adjacent the peripheral edge thereof.

42. The apparatus of claim 41, in which each one of said movable indicia is associated with a magnetic pole acting at the peripheral edge of said rotatable member.

43. The apparatus of claim 42, comprising a fixed magnet adjacent the peripheral edge of said rotatable member, each of said rest positions being defined by magnetic interaction between one of said magnetic poles and said fixed magnet.

44. The apparatus of claim 43, in which fixed indicia representative of one of said possible states for a line is situated between said fixed magnet and the axis of rotation of said rotatable member, at least a portion of the rotatable member being substantially transparent so that said fixed indicia is visible therethrough.

45. The apparatus of claim 44, comprising transformational indicia on the upper surface of said rotatable member and located to overlie at least a portion of said fixed indicia when said rotatable member is in one of said rest positions, such that when said transformational indicia is viewed together with said underlying fixed indicia the appearance of said fixed indicia is altered to a different one of said possible states.

46. Apparatus for determining by chance the state for each of a plurality of lines having more than one possible state, comprising:

means for representing the Yin-yang symbol as a plurality of substantially equal shaped sectors;

means for randomly selecting one of said sectors; and means for visibly recording as one of the possible states for a line the portion of the Yin-yang symbol represented by said selected sector.

* * * * *